US011332963B2

(12) United States Patent
Karlein et al.

(10) Patent No.: US 11,332,963 B2
(45) Date of Patent: May 17, 2022

(54) RETRACTABLE ARRANGEMENT FOR ACTUATING A VEHICLE DOOR WITH IMPROVED ICE-BREAKING FUNCTION

(71) Applicant: ILLINOIS TOOL WORKS INC., Glenview, IL (US)

(72) Inventors: Johannes Karlein, Frühlingstraße (DE); Roland Och, Rottendorf (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 554 days.

(21) Appl. No.: 16/247,105

(22) Filed: Jan. 14, 2019

(65) Prior Publication Data

US 2019/0218835 A1 Jul. 18, 2019

(30) Foreign Application Priority Data

Jan. 18, 2018 (EP) ..... 18152428

(51) Int. Cl.
*E05B 85/10* (2014.01)
*E05B 81/28* (2014.01)

(52) U.S. Cl.
CPC ..... *E05B 85/107* (2013.01); *E05B 81/28* (2013.01); *E05B 85/103* (2013.01); *E05Y 2900/531* (2013.01)

(58) Field of Classification Search
CPC ..... E05B 85/10; E05B 85/103; E05B 85/107; E05B 81/28; Y10S 292/31
See application file for complete search history.

(56) References Cited

U.S. PATENT DOCUMENTS

| | | | | |
|---|---|---|---|---|
| 9,605,452 | B2 | 3/2017 | Yoshino | |
| 10,954,702 | B2 * | 3/2021 | Couto Maquieira | E05B 85/107 |
| 2008/0100071 | A1 * | 5/2008 | Browne | B62D 35/008 292/341.17 |
| 2014/0265372 | A1 | 9/2014 | Smart | |
| 2016/0273247 | A1 | 9/2016 | Fujiwara | |
| 2016/0281397 | A1 | 9/2016 | Park | |
| 2016/0290018 | A1 | 10/2016 | Hamacher | |
| 2020/0362602 | A1 * | 11/2020 | Sobecki | E05B 1/0053 |

FOREIGN PATENT DOCUMENTS

| | | | | |
|---|---|---|---|---|
| CN | 103703202 | A | 4/2014 | |
| CN | 105332574 | A | 2/2016 | |
| CN | 105683468 | A | 6/2016 | |
| CN | 105849348 | A | 8/2016 | |
| CN | 106014024 | A | 10/2016 | |
| DE | 19508518 | A1 | 9/1996 | |
| DE | 10 2011 107 009 | | 1/2013 | |
| EP | 3073035 | A1 * | 9/2016 | E05B 85/103 |
| EP | 3540157 | A1 * | 9/2019 | E05B 85/16 |
| FR | 3023865 | A1 * | 1/2016 | E05B 85/107 |
| WO | WO2015074020 | A1 | 5/2015 | |
| WO | WO2016077068 | A1 | 5/2016 | |

* cited by examiner

*Primary Examiner* — Carlos Lugo
(74) *Attorney, Agent, or Firm* — Thompson Hine LLP

(57) ABSTRACT

An arrangement, the arrangement being designed for actuating a motor vehicle door, the arrangement having a handle which can be grabbed by a hand, the arrangement having an actuator which is connected to the handle via a coupling, it being possible for the handle to be moved from a rest position into a standby position by means of the actuator, the arrangement being designed to load the handle with a total restoring force which, starting from the standby position to back into the rest position, has an at least partially nonlinear profile.

14 Claims, 6 Drawing Sheets

RETRACTABLE ARRANGEMENT FOR ACTUATING A VEHICLE DOOR WITH IMPROVED ICE-BREAKING FUNCTION

TECHNICAL FIELD

The invention relates to generally retractable arrangements for actuating a motor vehicle door.

BACKGROUND

The prior art DE 10 2011 107 009 A1 discloses a retractable door handle which, during deployment, makes the deployment of the door handle possible by means of a wedge even in the frozen state.

The inventors considered it disadvantageous that the door handle can freeze even in the deployed state and can then no longer be retracted. Furthermore, there is in general the risk in the case of retractable door handles that fingers can be trapped on account of the restoring force which retracts the handle, with the result that the value of the restoring force is limited.

SUMMARY

The object, on which the invention is based, was to improve said disadvantage. The object is achieved by way of the invention, in particular as defined below.

In particular, said object is achieved by way of an arrangement, the arrangement being designed for actuating a motor vehicle door, the arrangement having a handle which can be grabbed by a hand, the arrangement having an actuator which is connected to the handle via a coupling, it being possible for the handle to be moved from a rest position into a standby position by means of the actuator, the arrangement being designed to load the handle with a total restoring force which, starting from the standby position and moving back into the rest position, has an at least partially non-linear profile.

The profile here is of the total restoring force as a function of handle position.

In one implementation, the total restoring force has a first force value when the handle is in the standby position and a second force value when the handle is in the rest position, the first force value being higher than the second force value, wherein the profile of the total restoring force is such that, at least in a middle portion of movement of the handle from the rest position to the standby position, the total restoring force is at least once lower than a theoretical linear restoring force profile that extends from the first force value to the second force value.

In one implementation, the total restoring force in the standby position has a higher value than a value of a theoretical restoring force at the standby position, which theoretical restoring force is according to a linear theoretical restoring force profile having a value at the rest position that is the same as a value of the total restoring force at the rest position.

In one implementation, the theoretical restoring force has an effective theoretical restoring force gradient in a first range of handle movement between the rest position and an intermediate position, and the total restoring force has an effective total restoring force gradient in the first range of handle movement, wherein the effective theoretical restoring force gradient is the same as the effective total restoring force gradient, wherein the effective theoretical restoring force gradient is defined as a change in a magnitude of the theoretical restoring force divided by a distance of handle movement in the first range of handle movement, and the effective total restoring force gradient is defined as a change in a magnitude of the total restoring force divided by the distance of handle movement in the first range of handle movement.

In one implementation, the linear theoretical restoring force profile matches the profile of the total restoring force in a first range of handle movement between the rest position and an intermediate position that is short of the standby position.

In one implementation, a first effective total restoring force gradient is defined as a change in a magnitude of the total restoring force from the standby position to the rest position divided by a distance of handle movement from the standby position to the rest position, wherein a second effective total restoring force gradient is defined as a change in the magnitude of the total restoring force from the intermediate position to the rest position divided by a distance of handle movement from the intermediate position to the rest position, and wherein the first effective total restoring force gradient is greater than the second effective total restoring force gradient.

This achieves a situation where, despite a restoring force which is kept small in the region of the rest position (and just before the latter), in order to further prevent finger trapping, the restoring force in the standby position is greater than might be achieved, for example, in the case of the use of a normal linear spring. In this way, the increase of the restoring force in the standby position with the aim of more reliable retraction (for example, in the case of blocking on account of dirt and/or ice) is achieved without a (substantial) increase in risk of injury as a result of trapping, which would not be the case, for example, if an existing linear restoring spring were instead merely replaced by a linear spring with a higher spring constant.

The coupling is preferably a mechanical connection of the actuator and the handle, which mechanical connection is set up to transmit an actuator force or an actuator torque and/or the resulting movement from the actuator to the handle. The coupling preferably has one or more levers which preferably mounts/mount the handle movably on the arrangement. The coupling preferably has a push rod which is driven by way of the actuator. The push rod preferably loads at least one of the levers.

The rest position is preferably a position, in which the handle cannot be gripped, or at least cannot be gripped as satisfactorily or comfortably as in the standby position (for example, by it being necessary for the handle to first of all be pulled manually from the rest position with a small area to act on, for example for only two fingers). The rest position is particularly preferably defined in such a way that the outer side of the handle terminates substantially flush with the surrounding door surface in that state of the arrangement, in which it is installed in the vehicle door.

The total restoring force at any given non-rest position of the handle is preferably the sum of all forces which operate to restore the handle into or toward the rest position, and the total restoring force at the rest position of the handle is the sum of all forces which operate to hold the handle in the rest position (e.g., force which must be overcome for the handle to move from the rest position toward the standby position). The theoretical restoring force is preferably the imaginary restoring force of a linear spring which acts directly on the handle. In one implementation, where the profile of the total restoring force is linear for some range of movement between the rest position and an intermediate position, the theoretical restoring force matches the total restoring force in that range of movement. A non-linear profile (or, as will be mentioned in the following text, a non-linear spring characteristic) preferably comprises profiles which are non-linear per se, but also profiles which are linear in sections, but have kinks or jumps.

It is provided in a further arrangement in accordance with the invention that the arrangement has a spring element which is designed to be tensioned by the actuator during a movement of the handle from the rest position in the direction of the standby position and to exert a spring restoring force on the handle.

This makes it possible that it is not the motor (that is to say, an active element), but rather a spring element which restores the handle into the rest position, which reduces the risk of injury in the case of trapping.

It is provided in a further arrangement in accordance with the invention that the spring element has a non-linear spring characteristic in which a region with an infinitesimal first spring constant is present with little deflection of the spring element, preferably the deflection which is set when the handle is situated in the rest position, and a region with an infinitesimal second spring constant is present with greater deflection of the spring element, preferably the deflection which is set when the handle is situated in the standby position, the second spring constant being greater than the first spring constant.

As a result, a profile according to the invention of the total restoring force is already achieved solely by way of the provision of said special spring element.

The spring element preferably has a progressive spring characteristic.

It is, for example, a spring element from the following spring elements which are particularly suitable for special spring characteristics of this type: air spring, gas pressure spring, rubber compression spring, specially wound helical spring, leaf spring, volute spring or cup spring.

It is provided in a further arrangement in accordance with the invention that the coupling is designed, for example by means of a cam mechanism, to couple the actuator to the handle in a movement region of the handle which begins in the standby position and extends in the direction of the rest position but ends before the rest position, in such a way that the actuator exerts an actuator restoring force on the handle, and the coupling being designed, after running through the movement region for a further movement of the handle toward the rest position, to uncouple the actuator from the handle in such a way, e.g., by the cam mechanism automatically decoupling, that the actuator can exert no actuator restoring force on the handle.

As a result, a profile according to the invention of the total restoring force is achieved by way of the coupling which is present in the region of the standby position and transmits a restoring force. The decoupling of the motor in the further movement toward the rest position reduces the risk of injury as a result of an uncontrolled actuator activation. The actuator is therefore used for restoring in the region of the standby position in addition to the first spring element.

It is provided in a further arrangement in accordance with the invention that the arrangement has an auxiliary spring element which is optionally preferably attached to the spring element or configured integrally with the latter, the arrangement being designed to deflect or further deflect the auxiliary spring element first in a second movement region of the handle with movement of the handle, which movement region begins in the standby position and extends in the direction of the rest position but ends before the rest position, the auxiliary spring element being designed to exert an auxiliary spring restoring force on the handle, in particular in the standby position.

As a result, a total restoring force according to the invention is achieved by means of an auxiliary spring which is active only in a defined movement region of the handle.

The arrangement preferably has the auxiliary spring element and the spring element.

The arrangement preferably has the auxiliary spring element and the spring element, and the abovementioned coupling which temporarily transmits a restoring force, or the coupling which will be mentioned in the following text and permanently transmits a restoring force, in order to further increase the restoring force in the standby position.

The second movement region is preferably identical or substantially identical to the abovementioned movement region. The two movement regions preferably at least contain the standby position.

It is provided in a further arrangement in accordance with the invention that the spring element is a torsion spring and the auxiliary spring element is formed by one of the outlet legs of the torsion spring.

A compact overall design is made possible as a result.

The torsion spring is preferably coupled to a lever arm, preferably at the rotary joint of the lever arm, with the result that the lever arm is restored by way of the torsion spring into that position of the lever arm which corresponds to the rest position X0 of the handle. The outlet leg is preferably clamped in or can be moved into a clamped-in position, with the result that, when the lever arm moves into that position of the lever arm which corresponds to the standby position X1 of the handle, part of the coupling, preferably of the lever arm, particularly preferably a projection of the lever arm, bends the outlet leg flexibly, said flexible bending generating a restoring force which is additional to the spring restoring force and/or is greater in comparison with the latter.

It is provided in a further arrangement in accordance with the invention that the arrangement has an electronic actuator control device for controlling the actuator, the actuator control device being designed to activate the actuator in a third movement region of the handle which begins in the standby position and extends in the direction of the rest position but ends before the rest position, in such a way that the actuator exerts an actuator restoring force on the handle, and the actuator control device being designed, after running through the third movement region for a further movement of the handle toward the rest position, to activate the actuator or switch it into an inactive state in such a way that the actuator exerts no or at most an overproportionally reduced actuator restoring force on the handle.

As a result, a total restoring force profile according to the invention is generated by means of a special actuator control operation.

The third movement region is preferably identical or substantially identical to the abovementioned movement region and/or second movement region. The movement regions preferably contain at least the standby position.

The different possibilities above for generating the total restoring force profile according to the invention (non-linear spring, temporary actuator coupling, temporary electronic actuation of the actuator with an increased restoring force, temporarily acting auxiliary spring) can be combined in each case with one another, in order to increase the restoring force in the standby position with a restoring force in the rest position which is at the same time kept low. This results in fifteen different possibilities to be used individually or in combination, and each individual one thereof is also disclosed hereby.

BRIEF DESCRIPTION OF THE DRAWINGS

The invention is now to be illustrated further by way of example using drawings, in which.

Figure 1A:
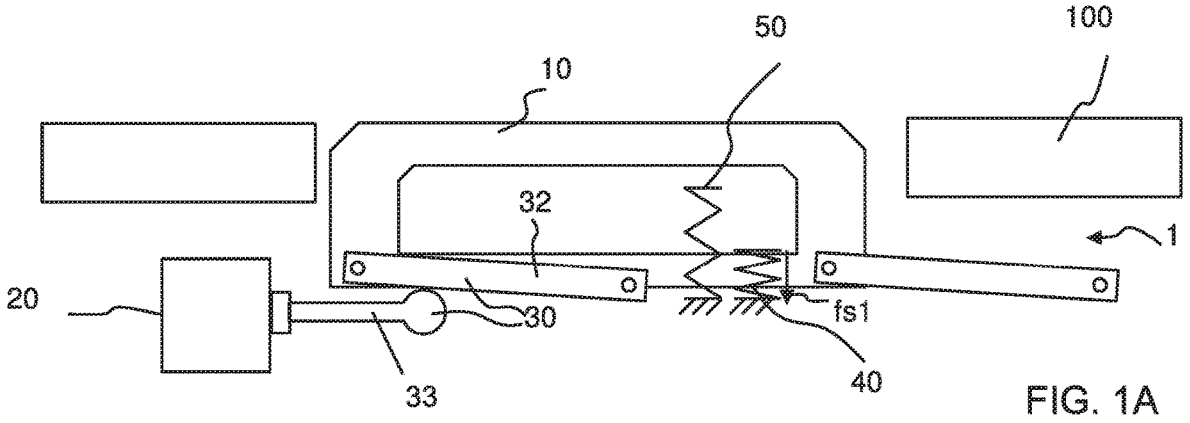
FIGS. 1A-1D show a first variant of an arrangement according to the invention, the rest position being shown in subfigure 1A, the standby position being shown in subfigure 1C, a position of the handle in between being shown in subfigure 1B, and the profile of the total restoring force in comparison with a theoretical restoring force being shown in subfigure 1D.
Figure 1B:
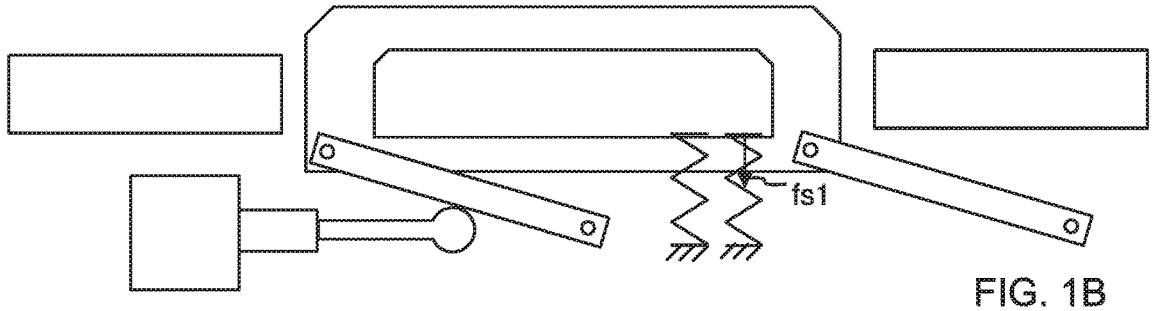
Figure 1C:
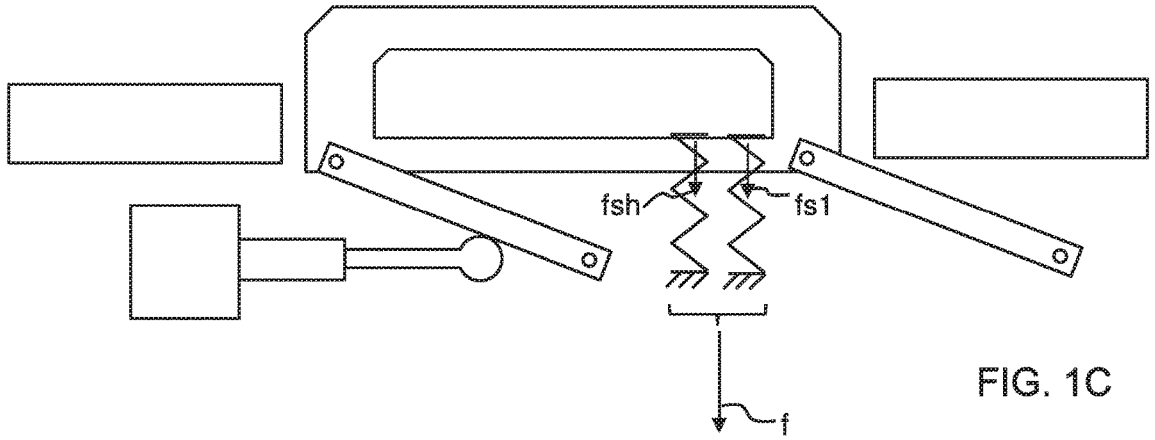

The arrows on the curves of the respective force profiles indicate the temporal sequence in the case of a movement of the handle from X1 to X0, for which temporal sequence the restoring force applies. Force may be, for example, measure in Newtons, and handle movement or position in millimeters.

DETAILED DESCRIPTION

A more detailed description of FIGS. 1A-1D follows. The configuration is such that the arrangement 1 is designed for actuating a motor vehicle door 100, the arrangement 1 having a handle 10 which can be grabbed by a hand, the arrangement 1 having an actuator 20 (e.g., motor or other actuator) which is connected to the handle 10 via a coupling 30, it being possible for the handle 10 to be moved from a rest position X0 into a standby position X1 by means of the actuator 20, the arrangement 1 being designed to load the handle with a total restoring force f which, starting from the standby position X1 back into the rest position X0, has an at least partially non-linear profile, the total restoring force fin the standby position X1 having a higher value F1 than the value Ft1 of a theoretical restoring force ft according to a linear profile with the same value Ft0, F0 of the theoretical restoring force ft and total restoring force fin the rest position X0. Here, the coupling 30 is a mechanical connection of the actuator 20 and the handle 10, which mechanical connection is designed to transmit an actuator force or an actuator torque and/or the resulting movement from the actuator 20 to the handle 10. Here, the coupling 30 has a plurality of levers 32 which mount the handle 10 movably on the arrangement 1. Other forms of links could be used. Here, the coupling has a push rod which is driven by way of the actuator 20. Here, the push rod loads at least one of the levers 32. Here, the rest position X0 is a position in which the handle 10 cannot be gripped, or at least cannot be gripped as satisfactorily or comfortably as in the standby position. The handle 10 would first of all have to be pulled out of the rest position manually by way of a small acting area. Here, the rest position X0 is defined in such a way that the outer side of the handle 10 terminates substantially flush with the surrounding door surface in that state of the arrangement 1, in which it is installed in the vehicle door 100. The configuration is such that the arrangement 1 has a spring element 40, operating at one force applying element, which is designed to be prestressed by way of the actuator 20 in the case of a movement of the handle 10 from the rest position X0 in the direction of the standby position X1, and to exert a spring restoring force fs1 on the handle 10. The configuration is such that the arrangement 1 has an auxiliary spring element 50, operating as another force applying element, the arrangement 1 being designed to deflect or further deflect the auxiliary spring element 50 with a movement of the handle 10 only in a second movement region ΔX2 of the handle 10 (e.g., the handle 10 has a surface configured such that the spring element 50 only contacts the handle surface when the handle is moving between the standby position of FIG. 1C and the intermediate position of FIG. 1B, thus the auxiliary spring element 50 only engages with the handle 10 between the standby position X1 and the intermediate position Xi2), such that the second movement region ΔX2 begins in the standby position X1 and extends in the direction of the rest position X0 but ends at an intermediate position Xi2 before the rest position X0, the auxiliary spring element 50 being designed to exert an auxiliary spring restoring force fsh on the handle 10, in particular in the standby position X1. Thus, in this example, the restoring force fsh and the restoring force fs 1 are only additive along part of the full range of movement of the handle between the standby position and the rest position, in particular along the movement region ΔX2. With respect to the profile in FIG. 1D, a first effective total restoring force gradient is defined as a change in the magnitude of the total restoring force f from the standby position X1 to the rest position X0 divided by a distance of handle movement from the standby position to the rest position (e.g., a gradient tracking theoretical force profile ft2). A second effective total restoring force gradient is defined as a change in a magnitude of the total restoring force between an intermediate position (e.g., Xi2, where ΔX2 ends) and the rest position divided by a distance of handle movement between the intermediate position and the rest position. A third effective total restoring force gradient is defined as a change in the magnitude of the total restoring force f from the standby position X1 to the intermediate position divided by a distance of handle movement from the standby position to the intermediate position. Notably, in this example, the first effective total restoring force gradient is greater than both the second effective total restoring force gradient and the third effective total restoring force gradient. The same holds true for the exemplary profiles depicted in FIGS. 2D and 3.

Figure 1D:
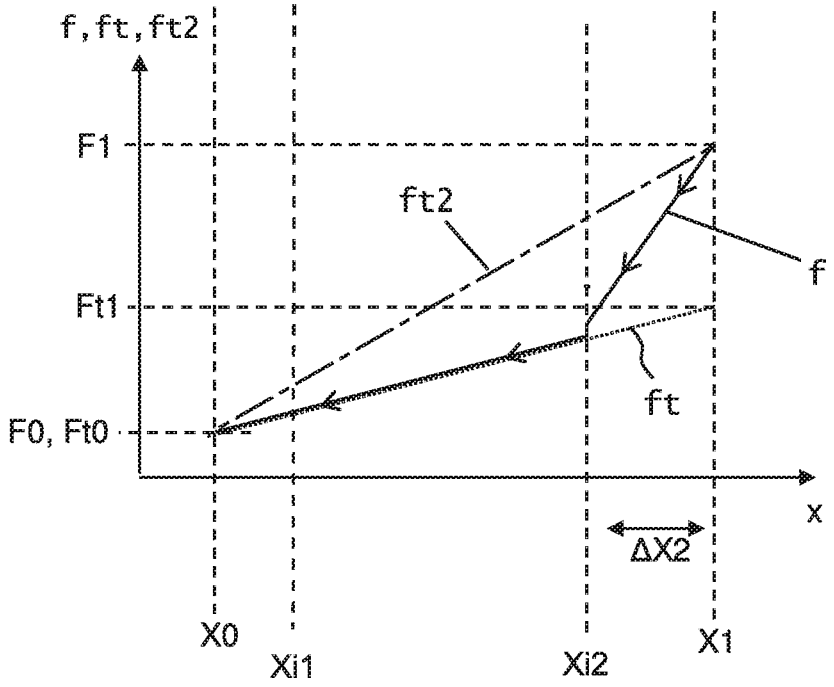
Figure 2A:
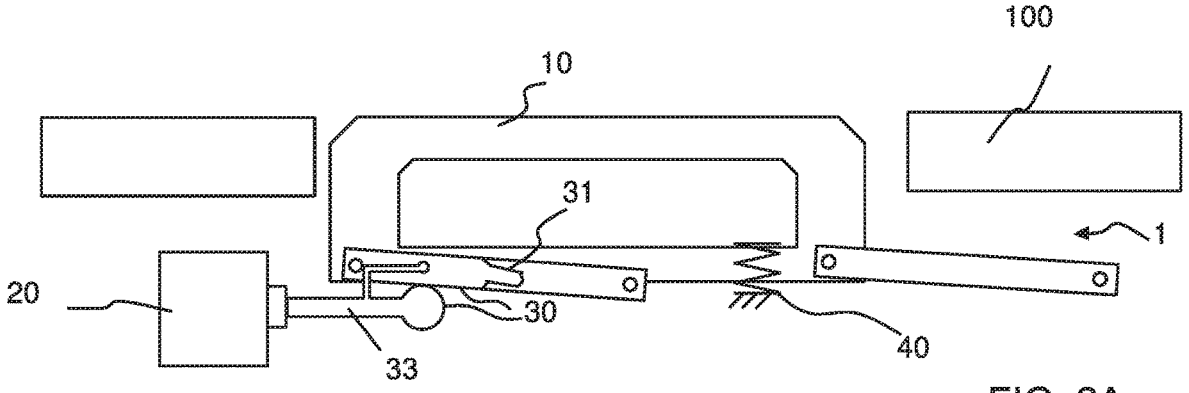
FIGS. 2A-2D show a second variant of an arrangement according to the invention, the rest position being shown in subfigure 2A, the standby position being shown in subfigure 2C, a position of the handle in between being shown in subfigure 2B, and the profile of the total restoring force in comparison with a theoretical restoring force being shown in subfigure 2D.
Figure 2B:
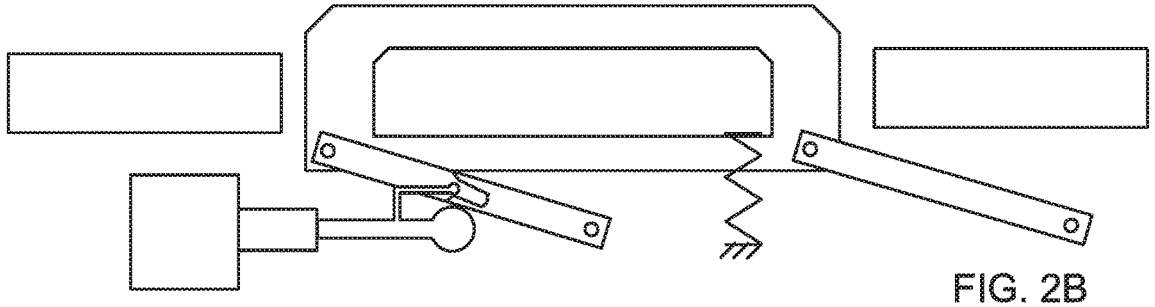
Figure 2C:
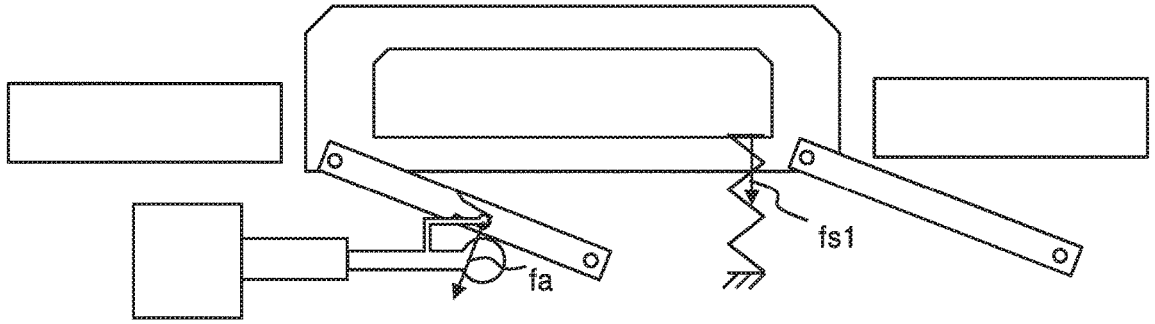
Figure 2D:
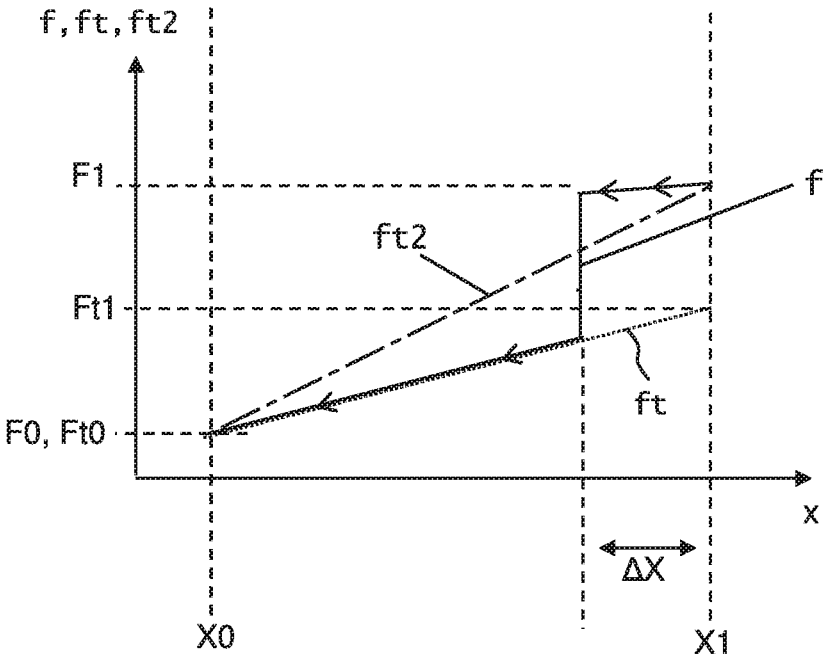

In the profile of FIG. 1D, the theoretical restoring force ft has an effective theoretical restoring force gradient in a first range of handle movement between the rest position and an intermediate position (e.g., between X0 and the inward end of ΔX2), and the total restoring force f has an effective total restoring force gradient in that first range of handle movement. Notably, in this example, the effective theoretical restoring force gradient in the first range is the same as the effective total restoring force gradient in the first range, and the two profiles overlap in the first range. The same holds true for the exemplary profiles depicted in FIGS. 2D and 3.

In addition, the total restoring force f has a high force value F1 when the handle is in the standby position and a low force value F0 when the handle is in the rest position, wherein the force value F1 is higher than the force value F0. Here, the profile of the total restoring force f is such that, at least along a middle portion of a full range of movement of the handle between the rest position and the standby position, the total restoring force f is at least once lower than a theoretical linear restoring force profile ft2 that extends linearly between the force value F1 and the force value F0. The same holds true for the exemplary profiles depicted in FIGS. 2D and 3.

In the example of FIG. 1D, position X0 represents the handle rest position, position X1 the handle standby position, and positions Xi1 and Xi2, two intermediate handle positions. In one example, position range X0 to Xi1 reflects positions of the handle where it is not possible to put a finger in (i.e., the handle has not yet protruded enough), position range Xi1 to Xi2 reflects positions of the handle where the handle is far enough out to put a finger in, but still close enough to the retract position to potentially trap a finger, and positions Xi2 to X1 represent positions of the handle where the handle is far enough out to both put a finger in and not present any finger trap concern. In a preferred embodiment of the arrangement, in the portion of handle movement that runs from Xi1 to Xi2, the total restoring force f is at least once lower than a theoretical linear restoring force profile ft2.

A more detailed description of FIGS. 2A-2D follows. The configuration is such that the coupling 30 is designed to couple the actuator 20 to the handle 10 by means of a cam mechanism 31 in a movement region of the handle 10, which movement region ΔX begins in the standby position X1 and extends in the direction of the rest position X0 but ends before the rest position X0, in such a way that the actuator 20, operating as another force applying element, exerts an actuator restoring force fa on the handle 10 (during initial retraction of the push rod 33), and the coupling 30 being designed, after running through the movement region ΔX for a further movement of the handle 10 toward the rest position X0, to uncouple the actuator 20 from the handle 10, by the cam mechanism 31 being decoupled automatically, in such a way that the actuator 20 can exert no actuator restoring force fa on the handle 10 (during continued retraction of the push rod 33). Thus, restoring forces fs1 and fa are only additive along the ΔX movement region. Depending on the configuration of the coupling, the resulting force profile f can have a greater or else smaller gradient in the region ΔX than in the region which leads to X0; in this example, the gradient in the region ΔX is smaller on account of the variable lever, with which the actuator 20 acts on the handle 10. A negative gradient is not ruled out in this region.

Figure 3:
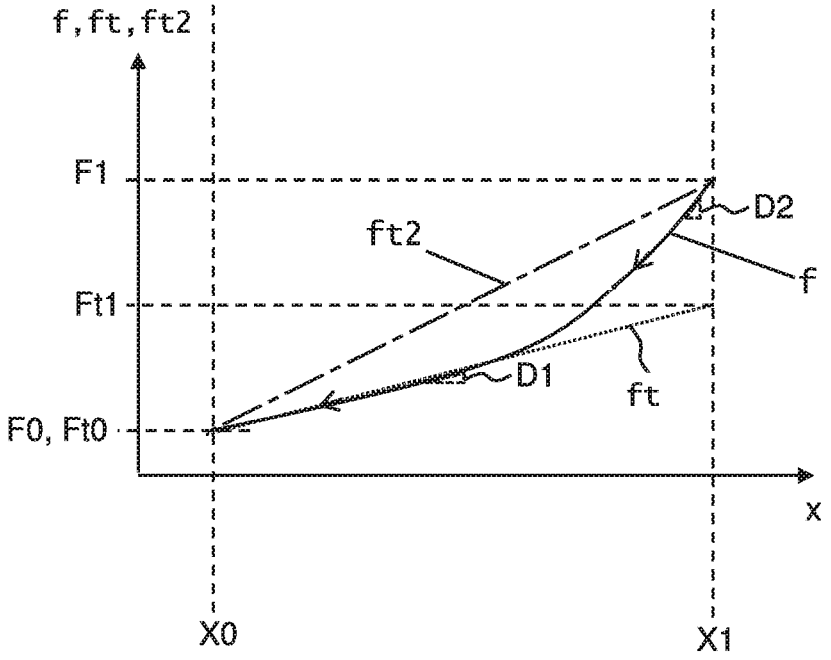
FIG. 3 shows a further variant of the arrangement according to the invention, merely the profile of the total restoring force in comparison with a theoretical restoring force being shown.
Figure 4A:
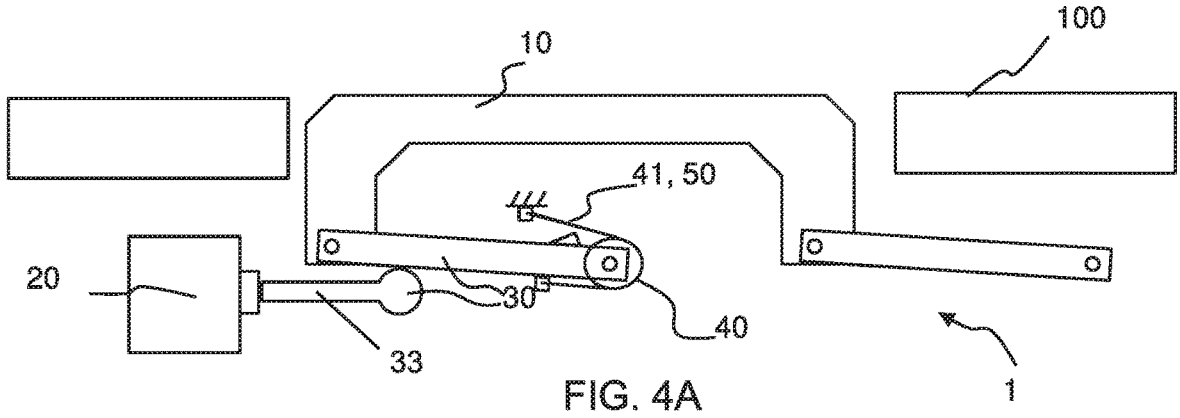
FIGS. 4A-4D show a variant which is similar in principle to the first variant, the two spring elements being combined in one element, however, and subfigure 4D being an enlarged detail view of subfigure 4C.
Figure 4B:
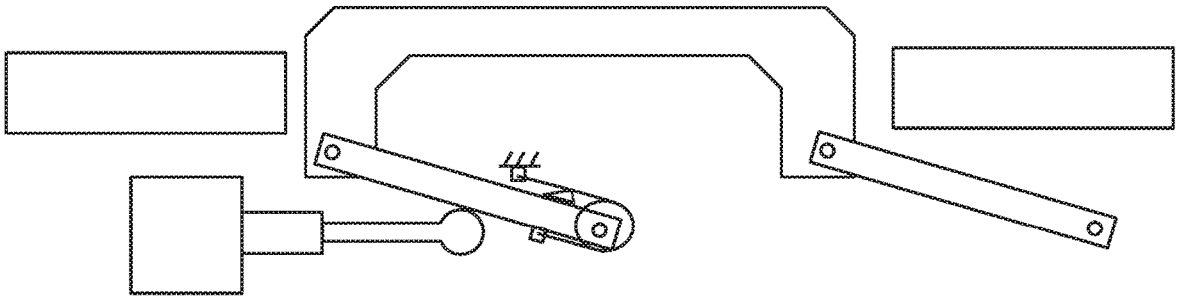
Figure 4C:
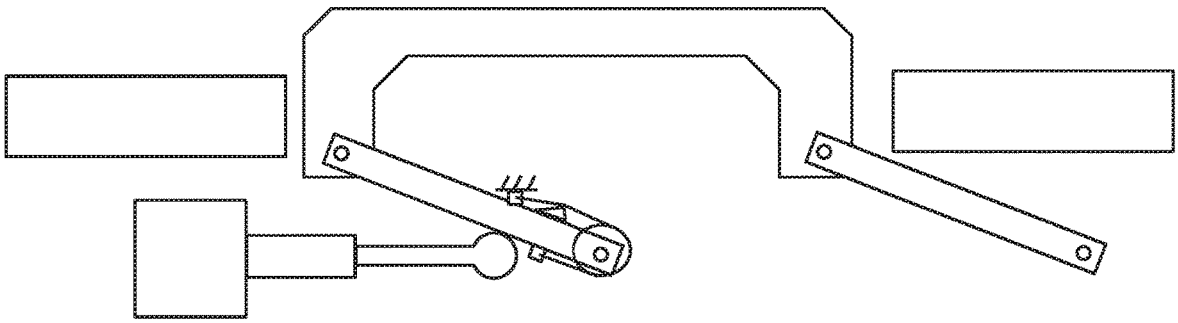
Figure 4D:
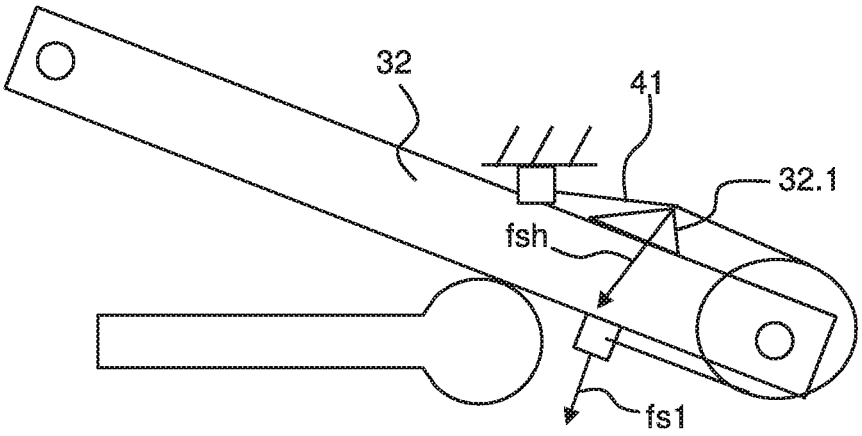

A more detailed description of FIG. 3 follows. The configuration is such that the spring element 40 has a non-linear spring characteristic, in which a region with an infinitesimal first spring constant D1 is present with little deflection of the spring element 40, the deflection here which is set when the handle 10 is situated in the rest position X0, and a region with an infinitesimal second spring constant D2 is present with greater deflection of the spring element 40, the deflection here which is set when the handle 10 is situated in the standby position X1, the second spring constant D2 being greater than the first spring constant D1. Here, the spring element has a progressive spring characteristic.

A more detailed description of FIGS. 4A-4D follows. The configuration is such that the spring element 40 is a torsion spring, and the auxiliary spring element 50 is formed by one of the outlet legs 41 of the torsion spring. Here, the auxiliary spring element 50 is attached to the spring element 40 or is configured integrally with the latter. Here, the torsion spring is coupled to a lever arm 32, at the rotary joint of the lever arm 32 here, with the result that the lever arm 32 is reset by way of the torsion spring into that position of the lever arm 32 which corresponds to the rest position X0 of the handle 10. Here, the outlet leg 41 is clamped in (i.e., in a fixed position), with the result that, when the lever arm 32 moves into that position of the lever arm 32 which corresponds to the standby position X1 of the handle 10, part of the coupling, here of the lever arm 32, here even a projection 32.1 of the lever arm 32, bends the outlet leg 41 flexibly, said flexible bending generating a restoring force fsh which is additional to the spring restoring force fs1. Notably, the restoring forces fs1 and fsh are only additive along part of the full range of movement of the handle.

Features of the invention include those in the following paragraphs A-H, as well as those specified in the claims.

A. An arrangement (1), the arrangement (1) being designed for actuating a motor vehicle door (100), the arrangement (1) having a handle (10) which can be grabbed by a hand, the arrangement (1) having an actuator (20) which is connected to the handle (10) via a coupling (30), it being possible for the handle (10) to be moved from a rest position (X0) into a standby position (X1) by means of the actuator (20), wherein the arrangement (1) is designed to load the handle with a total restoring force (f) which, starting from the standby position (X1) to back into the rest position (X0), has an at least partially nonlinear profile.

B. The arrangement as claimed in paragraph A, wherein the total restoring force (f) in the standby position (X1) having a higher value (F1) than the value (Ft1) of a theoretical restoring force (ft) according to a linear profile with the same value (Ft0, F0) of the theoretical restoring force (ft) and total restoring force (f) in the rest position (X0).

C. The arrangement (1) as claimed in paragraph A or B, the arrangement (1) having a spring element (40) which is designed to be tensioned by the actuator (20) during a movement of the handle (10) from the rest position (X0) in the direction of the standby position (X1) and to exert a spring restoring force (fs1) on the handle (10).

D. The arrangement (1) as claimed in paragraph C, the spring element (40) having a nonlinear spring characteristic in which a region with an infinitesimal first spring constant (D1) is present with little deflection of the spring element (40) and a region with an infinitesimal second spring constant (D2) is present with greater deflection of the spring element (40), the second spring constant (D2) being greater than the first spring constant (D1).

E. The arrangement (1) as claimed in one of paragraphs C or D, the coupling (30) being designed to couple the actuator (20) to the handle (10) in a movement region (ΔX) of the handle (10) which begins in the standby position (X1) and extends in the direction of the rest position (X0) but ends before the rest position (X0), in such a way that the actuator (20) exerts an actuator restoring force (fa) on the handle (10), and wherein the coupling (30) is designed, after running through the movement region (ΔX) for a further movement of the handle (10) toward the rest position (X0), to uncouple the actuator (20) from the handle (10) in such a way that the actuator (20) can exert no actuator restoring force (fa) on the handle (10).

F. The arrangement (1) as claimed in one of paragraphs A-E, the arrangement (1) having an auxiliary spring element (50), the arrangement (1) being designed to deflect or further deflect the auxiliary spring element (50) first in a second movement region (ΔX2) of the handle (10) with movement of the handle (10), which movement region begins in the standby position (X1) and extends in the direction of the rest position (X0) but ends before the rest position (X0), the auxiliary spring element (50) being designed to exert an auxiliary spring restoring force (fsh) on the handle (10), in particular in the standby position (X1).

G. The arrangement (1) as claimed in one of paragraphs C and F, the spring element (40) being a torsion spring and the auxiliary spring element (50) being formed by one of the outlet legs (41) of the torsion spring.

H. The arrangement (1) as claimed in one paragraphs A-G, the arrangement having an electronic actuator control device for controlling the actuator (20), the actuator control device being designed to activate the actuator (20) in a third movement region of the handle (10) which begins in the standby position (X1) and extends in the direction of the rest position (X0) but ends before the rest position (X0), in such a way that the actuator (20) exerts an actuator restoring force (fa) on the handle (10), and the actuator control device being designed, after running through the third movement region for a further movement of the handle (10) toward the rest position (X0), to activate the actuator (20) or switch it into an inactive state in such a way that the actuator (20) exerts no or at most an overproportionally reduced actuator restoring force (fa) on the handle (10).

LIST OF DESIGNATIONS

1 Arrangement
10 Handle which can be grabbed
20 Actuator
30 Coupling
31 Cam mechanism
32 Lever arm
32.1 Projection
33 Push rod
40 Spring element
41 Output limb
50 Auxiliary spring element
100 Motor vehicle door
ΔX Movement region
ΔX2 Movement region
D1 First spring constant
D2 Second spring constant
F0 Value off in position X0
F1 Value off in position X1
Ft0 Value of ft in position X0
Ft1 Value of ft in position X1
X0 Rest position
X1 Standby position
Xi1 Intermediate position
Xi2 Intermediate position
f Total restoring force
fa Actuator restoring force
fs1 Spring restoring force
fsh Auxiliary spring restoring force
ft Theoretical restoring force
ft2 Theoretical restoring force

The invention claimed is:

1. An arrangement, wherein the arrangement is designed for actuating a motor vehicle door, wherein the arrangement has a handle which can be grabbed by a hand, wherein the arrangement has an actuator which is connected to the handle via a coupling, wherein the handle can be moved from a rest position into a standby position by means of the actuator, wherein the arrangement includes a force applying system that is configured to interact with the handle so as to load the handle with a total restoring force which, starting from the standby position moving back into the rest position, has an at least partially non-linear profile;

wherein the total restoring force defines:

a first effective total restoring force gradient, exerted by a plurality of components of the force applying system, defined as a change in a magnitude of the total restoring force from the standby position to the rest position divided by a distance of handle movement from the standby position to the rest position, a second effective total restoring force gradient, exerted by less than the plurality of components of the force applying system, defined as a change in the magnitude of the total restoring force from the intermediate position to the rest position divided by a distance of handle movement from the intermediate position to the rest position, and wherein the first effective total restoring force gradient is greater than the second effective total restoring force gradient.

2. The arrangement according to claim 1, wherein the total restoring force has a first force value when the handle is in the standby position and a second force value when the handle is in the rest position, the first force value being higher than the second force value, wherein the profile of the total restoring force is such that, at least in a middle portion of movement of the handle from the rest position to the standby position, the total restoring force is at least once lower than a theoretical linear restoring force profile that extends from the first force value to the second force value.

3. The arrangement according to claim 1, wherein the total restoring force in the standby position has a higher value than a value of a theoretical restoring force at the standby position, which theoretical restoring force is according to a linear theoretical restoring force profile having a value at the rest position that is the same as a value of the total restoring force at the rest position, wherein the linear theoretical restoring force profile matches the profile of the total restoring force in a first range of handle movement between the rest position and an intermediate position that is short of the standby position.

4. The arrangement as claimed in claim 1, the force applying system having a spring element that forms one of the plurality of components of the force applying system, which spring element is designed to be tensioned during a movement of the handle from the rest position in the direction of the standby position and to exert a spring restoring force on the handle.

5. The arrangement as claimed in claim 4, the coupling being designed to couple the actuator to the handle in a movement region of the handle which begins in the standby position and extends in the direction of the rest position but ends before the rest position, in such a way that the actuator forms another one of the plurality of components of the force applying system and exerts an actuator restoring force on the handle, and wherein the coupling is designed, after running through the movement region for a further movement of the handle toward the rest position, to uncouple the actuator from the handle in such a way that the actuator can exert no actuator restoring force on the handle.

6. The arrangement as claimed in claim 4, the force applying system having an auxiliary spring element that forms another one of the plurality of components of the force applying system, the arrangement being designed to deflect or further deflect the auxiliary spring element first in a movement region of the handle with movement of the handle, which movement region begins in the standby position and extends in the direction of the rest position but ends before the rest position, the auxiliary spring element being designed to exert an auxiliary spring restoring force on the handle in the standby position.

7. The arrangement as claimed in claim 6, the spring element being a torsion spring and the auxiliary spring element being formed by one of the outlet legs of the torsion spring.

8. The arrangement as claimed in claim 1, the arrangement having an electronic actuator control device for controlling the actuator, the actuator control device being designed to activate the actuator in a movement region of the handle which begins in the standby position and extends in the direction of the rest position but ends before the rest position, in such a way that the actuator forms one of the plurality of components of the force applying system and exerts an actuator restoring force on the handle, and the actuator control device being designed, after running through the movement region for a further movement of the handle toward the rest position, to activate the actuator or switch it into an inactive state in such a way that the actuator exerts no or at most an overproportionally reduced actuator restoring force on the handle.

9. An arrangement for actuating a motor vehicle door, the arrangement comprising:

a handle which can be grabbed by a hand, the handle having a rest position, a standby position and an intermediate position therebetween, an actuator connected to the handle via a coupling such that operation of the actuator can move the handle from the rest position into the standby position, wherein the arrangement includes a force applying system that is configured to interact with the handle so as to load the handle with a total restoring force which varies according to handle position, wherein a profile of the total restoring force verses handle position is at least partially non-linear between the standby position and the rest position;

wherein the force applying system includes at least first and second force applying elements configured to interact with the handle and/or the actuator such that, between the rest position and the intermediate position, the total restoring force is defined by a restoring force applied to the handle by the first force applying element and, between the intermediate position and the standby position, the total restoring force is defined by an additive combination of the restoring force applied to the handle by the first force applying element and a restoring force applied to the handle by the second force applying element.

10. The arrangement of claim 9, wherein the second force applying element does not apply any restoring force to the handle when the handle is in the rest position.

11. The arrangement of claim 9, wherein the first force applying element comprises a first spring and the second force applying element comprises a second spring.

12. The arrangement of claim 9, wherein the first force applying element comprises a spring and the second force applying element comprises the actuator interacting and/or part of the coupling.

13. The arrangement of claim 9, wherein the total restoring force has a first force value when the handle is in the standby position and a second force value when the handle is in the rest position, wherein the first force value is higher than the second force value, wherein the profile of the total restoring force is such that, at least along a middle portion of a full range of movement of the handle between the rest position and the standby position, the total restoring force is at least once lower than a theoretical linear restoring force profile that extends linearly between the first force value and the second force value.

14. An arrangement for actuating a motor vehicle door, the arrangement comprising:

a handle which can be grabbed by a hand, the handle having a rest position, a standby position and an intermediate position therebetween, an actuator connected to the handle via a coupling such that operation of the actuator can move the handle from the rest position into the standby position, wherein the arrangement includes a force applying system that is configured to interact with the handle so as to load the handle with a total restoring force which varies according to handle position, wherein a profile of the total restoring force verses handle position is at least partially non-linear, wherein the total restoring force defines:

a first effective total restoring force gradient, exerted by a plurality of components of the force applying system, defined as a change in a magnitude of the total restoring force from the standby position to the rest position divided by a distance of handle movement from the standby position to the rest position, a second effective total restoring force gradient, exerted by less than the plurality of components of the force applying system, defined as a change in the magnitude of the total restoring force from the intermediate position to the rest position divided by a distance of handle movement from the intermediate position to the rest position, and wherein the first effective total restoring force gradient is greater than the second effective total restoring force gradient.

* * * * *